United States Patent [19]

Coleman

[11] Patent Number: 4,465,194

[45] Date of Patent: Aug. 14, 1984

[54] THRESHED TOBACCO LEAD SEPARATOR

[75] Inventor: G. A. John Coleman, Richmond, Va.

[73] Assignee: Universal Leaf Tobacco Co., Richmond, Va.

[21] Appl. No.: 452,803

[22] Filed: Dec. 23, 1982

[51] Int. Cl.[3] ..... B07B 4/00

[52] U.S. Cl. ..... 209/639; 209/638; 209/664; 209/138; 209/139 A; 209/142

[58] Field of Search ..... 209/535, 637–640, 209/642, 422, 466–467, 134–137, 142, 143, 153, 154, 643, 644, 138, 139, 664

[56] References Cited

U.S. PATENT DOCUMENTS

| | | | |
|---|---|---|---|
| 2,667,174 | 1/1954 | Eissmann | 209/143 X |
| 3,608,716 | 9/1971 | Rowell et al. | 209/154 X |
| 3,878,091 | 4/1975 | Hukki | 209/135 X |
| 3,933,626 | 1/1976 | Stukel et al. | 209/134 |

*Primary Examiner*—Robert B. Reeves
*Assistant Examiner*—Glenn Foster
*Attorney, Agent, or Firm*—Cushman, Darby & Cushman

[57] ABSTRACT

A high efficiency tobacco separator for separating lighter particles such as leaf or lamina from heavier particles such as stem in a tobacco mixture have a primary and a secondary air separation chamber. Two winnowers are provided in the primary chamber for tossing tobacco mixture back and forth across the chamber. A generally upward air flow is established in both the primary chamber and the secondary chamber, and the air flow, combined with inertial and gravitational effects, functions to separate lighter particles from heavier particles by entraining the lighter particles in the upward air flow. A conveyor assembly is positioned across the bottom of a primary chamber and extending into and projecting into the secondary chamber. The conveyor arrangement accumulates heavier particles which fall to the bottom of the primary chamber and projects them into the secondary chamber where additional air flow separation occurs. Entrained lighter particles are accelerated towards the top of the primary and secondary chambers and are collected. Heavier particles fall to the bottom of the secondary chamber and are collected.

17 Claims, 2 Drawing Figures

THRESHED TOBACCO LEAD SEPARATOR

BACKGROUND OF THE INVENTION

This invention pertains to a pneumatic or aerodynamic type separator for separation of lighter and heavier particles in a mixture. The invention particularly relates to such a separator for use in separating stems from fragments of tobacco leaves.

In general, the use of pneumatic type separators for separating stems from leaf fragments in a tobacco mixture is known. Examples of such prior art systems include those disclosed in U.S. Pat. No. 3,608,716 to Rowell, U.S. Pat. No. 2,941,667 to Hilgartner et al, U.S. Pat. No. 3,006,470 to Franken and U.S. Pat. No. 3,265,210 to Harte et al. The present invention represents an improvement over this various prior art in that higher efficiency separation of tobacco stems from leaves is achieved.

SUMMARY OF THE INVENTION

It is an object of this invention to provide a separator for separating stems from leaves in a tobacco mixture.

It is a more specific object of this invention to provide such a tobacco separator which has a very high efficiency.

It is a still more specific object of this invention to provide a tobacco separator using two co-acting winnowers combined with inertial and plural air separators.

Briefly, in accordance with one embodiment of the invention, primary and secondary separation chambers are provided. The primary chamber has two winnowers mounted on opposite sides for co-action in projecting tobacco mixture back and forth across the primary chamber. Means are provided to establish a generally upward air flow in both the primary and secondary chambers. The air flow in the primary chamber serves to entrain and carry upwards to a collection duct the lighter particles. Conveyor means are provided at the bottom of the primary chamber to collect heavier particles that fall to the bottom of the primary chamber and transport and project them into the secondary chamber. The air flow in the secondary chamber serves to entrain and carry upwards to a collection duct additional lighter particles. Means are provided in the bottom of the secondary chamber to collect heavier particles that fall to the bottom of the secondary chamber.

DETAILED DESCRIPTION

Figure 1:
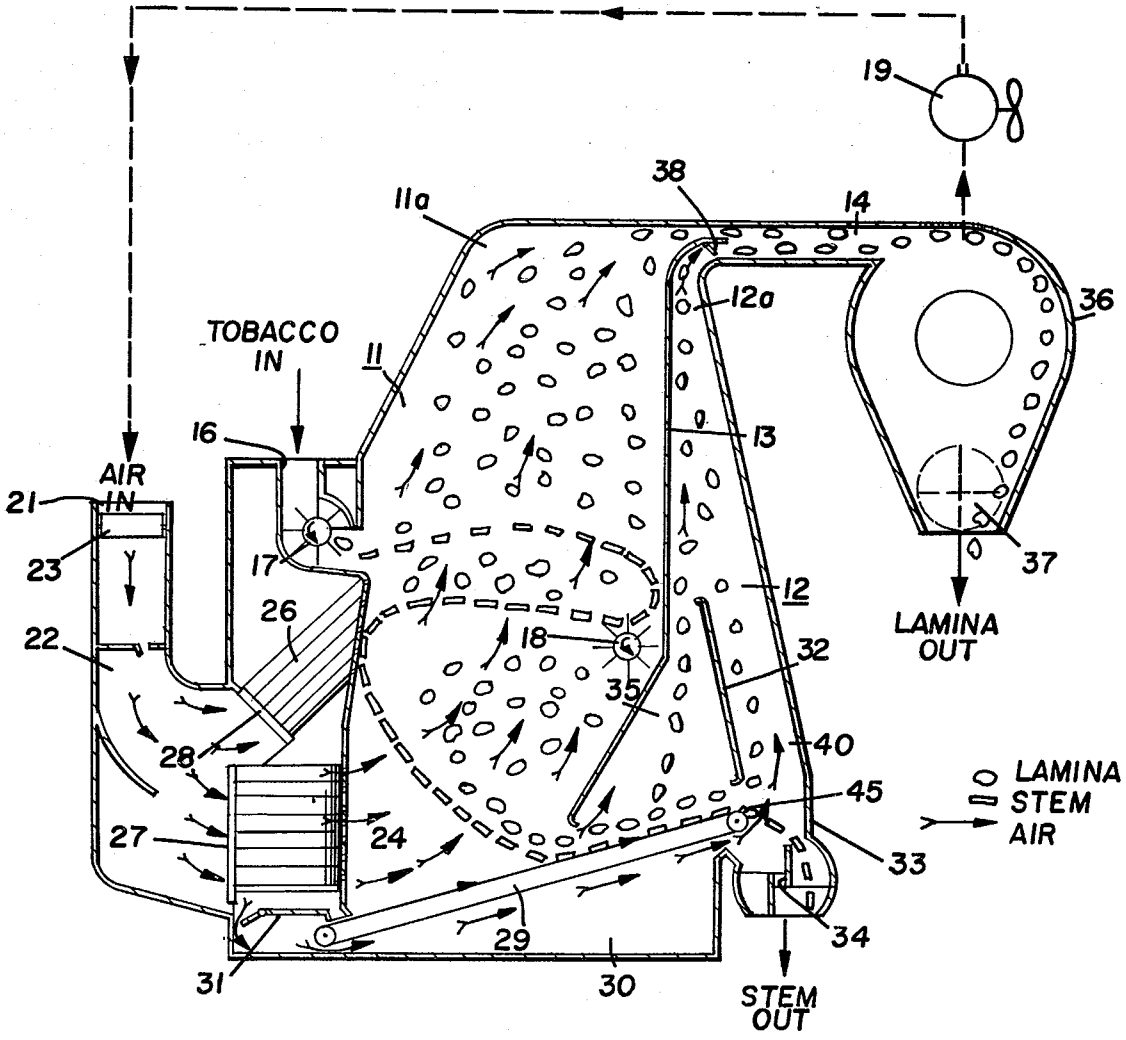
FIG. 1 is a diagrammatic sectional elevation of one embodiment of a separator in accordance with the present invention.

Prior to providing a detailed description of the exemplary preferred embodiments of the present invention, it is instructive to briefly examine the theoretical basis on which pneumatic or aerodynamic type separators function. Of course, the purpose of such a separator is to separate leaf fragments from stems in a threshed tobacco mixture. Generally, such a threshed mixture will contain whole tobacco leaves, leaves with attached stem, pieces of leaf with no stem, and pieces of stem with no leaf.

There is basically only one definite distinction between free lamina and the other products in a threshed tobacco mixture which provides a basis for mechanical separation. This is the ratio between surface area and weight. A piece of free lamina generally has a much higher surface area to weight ratio than the other products, because of the higher density and cylindrical shape of a stem.

Consider, for example, a piece of tobacco lamina 1"×1"×0.01", with a density of $\rho$ pounds/cubic inch.

$$\text{Maximum surface area } A_L = 1'' \times 1'' = 1 \text{ in.}^2 \quad (1)$$

$$\text{Weight } W_L = 1'' \times 1'' \times 0.01'' \times \rho = 0.01\rho \text{ lb.} \quad (2)$$

$$\text{Weight to surface area ratio } \frac{W_L}{A_L} = \frac{0.01\rho}{1} = 0.01\rho \text{ lb./in.}^2 \quad (3)$$

Consider now a piece of clean tobacco stem 1" long, with a mean diameter of 0.1" and with a density of $2\rho$ lb/in.$^3$ $$\text{Maximum surface area } A_S = 1 \times .1 \text{ (plane)} = 0.1 \text{ in.}^2 \quad (4)$$

$$\text{Weight } W_S = 1 \times (.05)^2\pi \times 2\rho = 1.57\rho \times 10^{-2} \quad (5)$$

$$\text{Weight to surface area ratio } \frac{W_S}{A_S} = \frac{1.57\rho}{.1} \times 10^{-2} = 0.157\rho \text{ lb/in.}^2 \quad (6)$$

Therefore, comparing the surface area to weight figures for lamina and stems, it may be seen that:

$$\frac{W_S}{A_S} : \frac{W_L}{A_L} = \frac{.157\rho}{.01\rho} = 15.7 \quad (7)$$

This considerable difference makes the effect of an airflow on the component pieces very distinctive, providing that the lamina is not curled up and the stem does not have any lamina adhering to it.

To better understand the aerodynamic effect on each particle, consider the basic formula for impulse which is:

$$FT = M(V_1 - V_2) \quad (8)$$

Where

F=Force

T=Time (For which force acts)

M=Mass of particle $V_1$=Initial velocity $V_2$=Final velocity

Also consider the basic force of gravity, which on a particle of mass M, will be $$F = Mg \quad (9)$$

Where g=gravitational acceleration

Applying these two principles to a particle of tobacco in equilibrium in a vertical air stream, and assuming that the maximum surface area is exposed at 90° to the airstream, neglecting any negative pressure on the downstream side, the following must be true:

$$M_1 g = FT = M_2(V_1 - V_2) \quad (10)$$

Where $M_1$=mass of particle $M_2$=mass of air

For convenience, let T=1 sec. If the surface area of the particle is 1 $Ft^2$ and $V_2$ is 0 ft/sec, then $$M_1 g = P_A V \cdot (V - 0) = P_A V^2 \quad (11)$$

$$\text{i.e. } V = \sqrt{\frac{M_1 g}{P_A}} \quad (12)$$

Where $P_A$=density of air in $lb/ft^3$ i.e. $V \propto \sqrt{M}$

Now, for stems and lamina of equal plane surface area, stems are 15.7 times heavier (in the case in question).

$$\frac{V_S}{V_L} = \sqrt{\frac{15.7}{1}} = 3.96 \quad (13)$$

Note that this is a hypothetical case to demonstrate the aerodynamic difference in principle only. In actual fact, depending on many factors, the distinction may be very little or non-existant. Thus no separator can be 100% efficient. However, by dispersing the particles well, and controlling the velocity of air within the separator chamber by means of dampers, a reasonable degree of efficiency can be attained.

The important factor in achieving a high degree of efficiency in a separating chamber is the dispersion of the various particles in such a way that each is acted upon separately by the airstream. Again, the disparity in surface area to weight ratios is an advantage. By projecting the particles horizontally across the airflow, two forces must act on each particle in the horizontal plane. These are the initial kinetic energy of the particle at the moment it enters the chamber, and the drag imposed by the air on the particle travelling through it. In the case of the lamina, the weight is low and surface area high. Thus it travels only a short distance before the drag has dissipated its kinetic energy. In the case of a stem, the opposite is true, and it travels much further. This gives a convenient basis for dispersing the tobacco.

Turning now to FIG. 1, there is shown a diagrammatic sectional view of a high efficiency separator in accordance with one embodiment of the invention. An enclosure is provided defining a primary separation chamber generally indicated by reference numeral 11 and a secondary separation chamber generally indicated by reference numeral 12. The primary and secondary chambers are adjacent to one another and are separated by a divider plate 13. As shown in FIG. 1, the primary and secondary chambers have respective hood portions 11*a* and 12*a*, with the walls defining the hood portions tapering in so as to gradually reduce the cross-sectional area of the chambers adjacent the top thereof. The hood sections 11*a* and 12*a* commonly terminate at an unloading duct 14.

An inlet 16 is provided for admitting a threshed tobacco mixture into the primary chamber. Situated adjacent the inlet is a first paddle type winnower 17. The winnower 17 is coupled to a source of power (not shown) and is adapted to rotate in the direction shown by the arrow in FIG. 1. A second paddle type winnower 18 is mounted in the primary chamber 11 at a side thereof opposite the side where the first winnower 17 is mounted. The winnower 18 is also adapted to be driven by a power source (not shown) for rotation in the direction indicated by the arrow shown on the winnower 18 in FIG. 1.

A suitably sized fan 19 is provided as a source of air for the separator. Air from fan 19 is coupled through an inlet 21 into a plenum chamber 22. A damper 23 can be provided adjacent the air inlet 21 for adjusting the amount of air admitted to the plenum chamber 22. Both a horizontal tubular diffuser 24 and an inclined tubular diffuser 26 are mounted in the side of the primary chamber underneath the first winnower 17. These two tubular diffusers are coupled to the plenum chamber 22, and air in the plenum chamber 22 is admitted to the primary chamber 11 by means of these tubular diffusers. The tubular diffusers respectively include slide plates 27 and 28 for adjustments of the volume of air admitted through the diffusers into the primary chamber 11.

A conveyor means 29, which can be a simple belt conveyor, is provided extending across the bottom of the primary chamber 11 and into the secondary chamber 12. As shown in the drawing, the conveyor 29 is inclined upwardly across the bottom of the primary chamber 11 and into the secondary chamber 12.

A portion of the air from the tubular diffuser 24 is admitted via a damper 31 into a conduit 30 underneath the conveyor 29 and exits under a head roller 45 of the conveyor 29 into the bottom of the secondary chamber 12. The secondary chamber 12 includes an additional divider plate 32 extending only part way up the secondary chamber 12, as shown in FIG. 1. As shown in FIG. 1, the divider plate 32 separates the bottom of the secondary chamber 12 into a left portion 35 and a right portion 40. The conveyor means 29 extends across the left portion 35 such that the head roller 45 is underneath divider plate 32. Thus, the air coupled by conduit 30 establishes the generally upward air flow in the right portion 40 of the bottom of the secondary chamber. The upward air flow in the left portion 35 is primarily established by air from the horizontal diffuser 24 passing underneath divider plate 13.

Coupled to the bottom of the secondary chamber 12 is a stem collection chute 33. An air lock 34 is provided in the chute 33 for rotation in the direction shown to permit collection of tobacco stems while preventing air loss through the chute 33.

Tobacco lamina which are carried upwards in the primary and secondary chambers 11 and 12 are admitted into the unloading duct 14. The unloading duct 14 is coupled to a centrifugal separator 36 which also includes an air lock 37 for permitting collection of lamina without loss of air. Air from the centrifugal separator 36 is recycled to the fan 19. A damper 38 is provided at the top of the hood section 12*a* of the secondary chamber where it adjoins the unloading duct 14.

As an aid in understanding the operation of the embodiment of the invention shown in FIG. 1, lamina, stem, and air currents are represented in the drawing in accordance with the legend shown in FIG. 1.

In operation, air from the fan 19 is admitted through the air inlet 21 into plenum chamber 22, and from there to the tubular diffusers 24 and 26. The tubular diffuser 24 is horizontally disposed, and the tubular diffuser 26 is inclined upwardly. In accordance with one embodiment of the invention, it has been found that inclining the tubular diffuser 26 at an angle of 55° with respect to the horizontal works well in achieving desired air flows in the primary chamber 11. The velocity of the air entering through the two tubular diffusers into the primary chamber is controlled by the damper 23. The slide plate adjustments 27 and 28 on each of the two tubular diffusers serves to further control the amount of air admitted to the primary chamber, as well of course as the division of the air between the two tubular diffusers.

The air flow established by the two tubular diffusers in the primary chamber is generally shown by the arrows in FIG. 1. The air flow has both horizontal and vertical components, and the air flow is such as to establish a generally upwardly air flow in the primary chamber. The horizontal air components, particularly from the diffuser 24, also have strong horizontal components tending to establish air flow components from left to right in the lower portion of the primary chamber shown in FIG. 1.

Tobacco admitted through the inlet 16 is projected into the primary chamber 11 by the winnower 17. The tobacco thus projected into the primary chamber is acted upon by the intersecting upward air flow on the left hand side of the primary chamber, and to some extent by the upward air flow from horizontal diffuser 24, whose output is deflected by divider plate 13 upwards in the right hand portion of the primary chamber 11. A large proportion of free lamina in the thus projected tobacco mixture is carried upwards by the rising air flow in the primary chamber. The first paddle type winnower 17 and the second paddle type winnower 18 are, as shown, positioned on opposite sides of the primary chamber. Also, the second winnower 18 is positioned lower than the first winnower 17. The positioning relationship between the two winnowers 17 and 18 is such that the tobacco mixture tangentially projected by the first winnower 17 strikes the second winnower 18 positioned on the opposite side of the chamber 11. Of course, a large proportion of free lamina in the thus projected mixture is carried upwards by the rising air flow in the primary chamber 11 into the hood section 11*a*, and thus does not encounter the second winnower 18. The second winnower 18 projects the tobacco mixture in a slightly upward trajectory back across the primary chamber 11, where the thus projected mixture is once again acted upon by the horizontal and vertical components of the air from the diffuser 24. More separation takes place during the second pass across the primary chamber, with additional lighter particles such as lamina being carried upwardly by the air flow and the heavier particles such as stem being subject to greater inertial and gravitational forces so as to move downwardly in the primary chamber 11. Borderline particles projected by the winnower 18 are blown up the divider plate 13 by the air flow out of the diffuser 24, with the thus blown particles being picked up again by the winnower 18 and projected across the primary chamber for a second chance at separating light particles such as lamina from heavy particles such as stems. The heavy particles such as stem fall in the primary chamber to the inclined conveyor 29, and are carried by the inclined conveyor 29 underneath the divider plate 13 into the secondary chamber 12.

Thus, as has been described, in the primary chamber 11 the tobacco mixture is dispersed by the two winnowers 17 and 18 and by the turning air stream from the tubular diffusers 24 and 26 acting against the flow of tobacco from the second winnower 18. Separation of lighter particles such as lamina or leaf from heavier particles such as stem is effected all through the primary chamber 11. In the hood section 11*a* at the top of the primary chamber the cross-sectional area is gradually reduced, which has the effect of causing higher air velocities so that entrained lamina particles are accelerated into the loading duct 14. The loading duct 14 transports entrained lamina to a centrifugal or tangential separator 36 for separating the lamina from the air stream. The air is returned to the fan 19 and lamina exits through an air lock 37 for collection.

The secondary chamber 12 shown in FIG. 1 functions in accordance with the same separation principles as the primary chamber. However, the secondary chamber does not include any winnowers. Rather, the inclined conveyor 29 which conveys the heavier particles collected in the primary chamber into the secondary chamber also projects them into the bottom portion of the secondary chamber. In fact, the particles are projected into the air stream in the right portion 40 at the bottom of the secondary chamber. Air is admitted into the right portion 40 at the bottom of the secondary chamber via its path through the damper 31 and underneath head roller 45 of the conveyor 29. Air flow in the left portion 35 at the bottom of the secondary chamber is established by the horizontal diffuser 24 underneath the divider plate 13, all as shown by the arrows in FIG. 1.

The divider plate 32 positioned in the secondary chamber 12 near the bottom thereof provides the right portion 40 with a generally small cross-sectional area. The relatively small cross-section of the area 40 results in a relatively high velocity of air and entrained particles up from the bottom of the secondary chamber 12. However, once the entrained tobacco product reaches the top of the divider plate 32, the area of the secondary chamber suddenly increases, and the air velocity drops. This provides an area of flotation for lighter particles such as lamina where a fine control can be exercised over separation of lamina from heavier particles such as stem. Lamina is entrained by the upwardly rising air flow in the secondary chamber 12 and carried through the hood section 12*a* into the unloading duct 14. As shown in FIG. 1, the right bottom portion 40 is inclined to the left at the bottom of the secondary chamber. Thus, in the separation area above divider plate 32 any heavier particles such as stem are projected to the left above divider plate 32 and fall back down the secondary chamber 12, to the left of the divider plate 32 into the left portion 35 and again onto the conveyor belt 29. Thus, any lamina or lighter particles entrapped by a heavy leaf, for example, which falls back down to the left of the divider plate 32 will drop back onto the conveyor belt and will be projected back into the right portion 40 at the bottom of the secondary chamber 12 to provide another opportunity for separation.

Heavy particles such as stem fall to the bottom of the secondary chamber 12 and pass into a stem collection chute 33, which may include an air lock means 34 rotating as shown in FIG. 1 for discharging the stems and heavier particles without air leakage.

The separator as has been described in connection with FIG. 1 thus provides a total of four opportunities for separation of lighter particles such as lamina or leaf from heavier particles such as stem to take place. The separator in accordance with this invention has a far higher efficiency than previous separation machines which provided only two opportunities at most for separating lighter particles from heavier particles. The separator of this embodiment of the invention has simplified controls in that there is a main damper 23 to regulate the total circulation of air in the primary and secondary chambers, and two secondary dampers 31 and 38 which, functioning together, control the flow of air and hence separation in the secondary chamber 12. The separator in accordance with FIG. 1 may be constructed in various widths to accommodate various loads, and has an approximate air volume requirement of 2,000 SCFM per foot of width.

The use of two winnowers in accordance with the present invention enables the tobacco mixture to be projected twice across the primary chamber, thus dispersing the tobacco mixture much better than the prior art. It also enables the machine to be loaded and unloaded at opposite ends, which makes the incorporation of a secondary separation chamber 12 possible.

Figure 2:
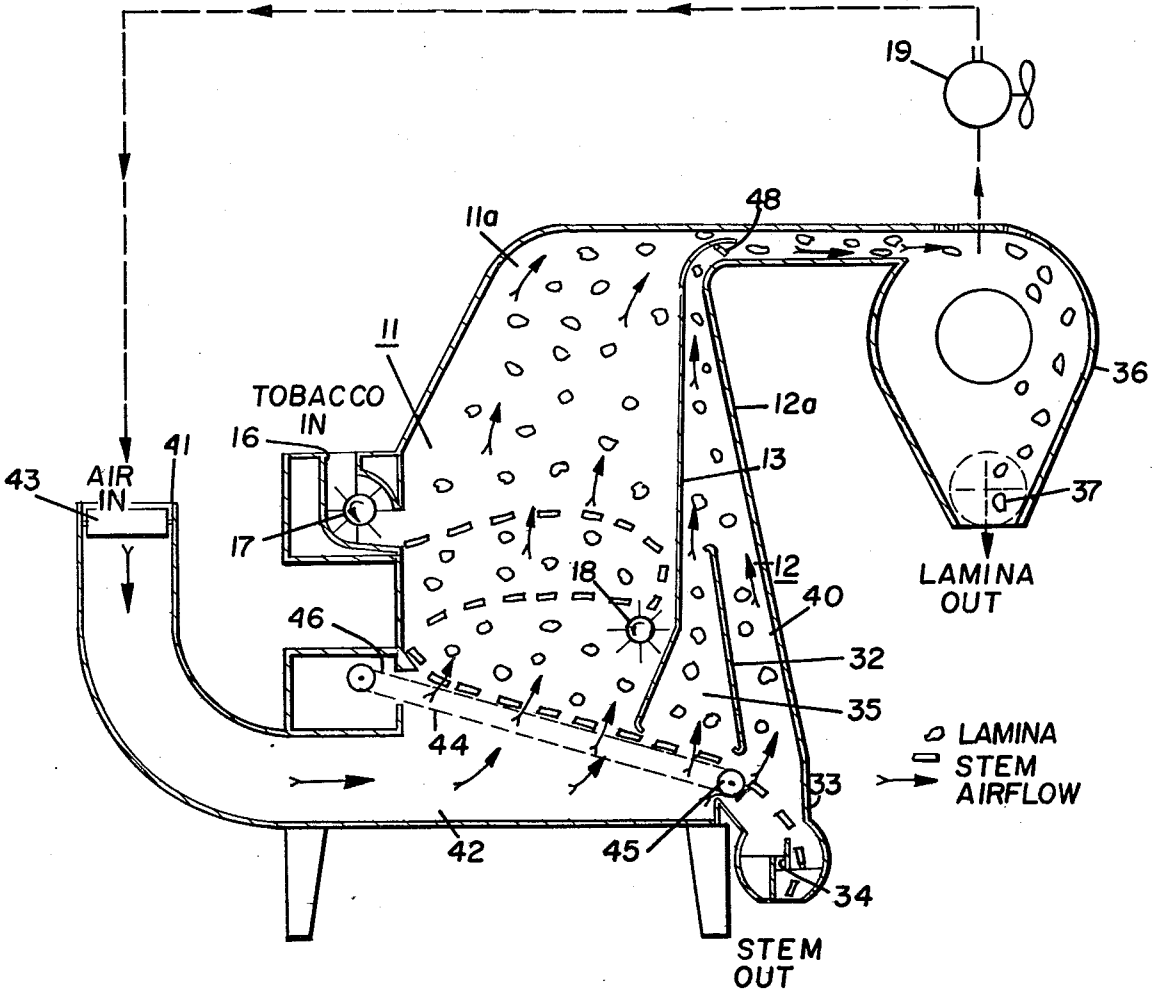
FIG. 2 is a diagrammatic sectional elevation of another embodiment of a separator in accordance with the present invention in which the air supply to the primary and secondary chambers is admitted through perforations in a conveyor belt.

Turning now to FIG. 2, there is shown a diagrammatic sectional view of an additional embodiment of a high efficiency separator in accordance with the principles of the present invention. In the embodiment of the invention shown in FIG. 2 the details of the separator are similar to a large extent to the details of the separator of FIG. 1, and like reference numerals have been used in FIG. 2 to refer to portions of the separator of FIG. 2 that are unchanged over that shown and described in connection with FIG. 1. The main difference between the embodiment of the invention shown in FIG. 2 and that described in connection with FIG. 1, is the manner in which air is supplied and admitted into the primary and secondary chambers of the separator. In the embodiment of FIG. 2, air from the fan 19 is admitted via an air inlet 41 into a plenum chamber 42. A damper 43 is disposed adjacent the air inlet for regulating the volume of air admitted. As before, a conveyor means 44 is disposed across the bottom of the primary chamber 11 and extending across a portion of and into the secondary chamber 12 adjacent the bottom thereof. In accordance with this embodiment of the invention, the conveyor means 44 is a belt conveyor that has a belt 46 that is perforated for admitting air to pass therethrough. In the case of the embodiment of FIG. 2, the conveyor means 44 is inclined, but inclined downwardly across the bottom of the primary chamber 11 and extends into the secondary chamber 12 across the left portion 35 terminating generally under the divider plate 32. In the embodiment of the invention illustrated in FIG. 2, air that is used for separation in the primary and secondary chambers enters from underneath and passes through the perforated belt 46 into the primary chamber 11 and the left portion 35 at the bottom of the secondary chamber 12. For the separation in the main chamber 11, air passes through the perforations in the belt 46, with the perforations acting to diffuse the air effectively, and the air flow within the primary chamber 11 is vertical. The belt 46 in the embodiment of FIG. 2 is self-cleaning as it travels from top to bottom. In accordance with one embodiment of the invention, the conveyor means 44 is inclined at an angle of 15° from the horizontal, and extending "downhill" across the bottom of the primary chamber into the secondary chamber. The reason for the incline of the conveyor means 44 is to assist in the discharge of the heavier particles. That is, due to the air rising through the perforations in the perforated belt 46 there is somewhat of an air-cushion effect, so that the heavy particles carried on the belt receive very little traction from the belt. Inclining the belt assists in the belt serving to transport heavy particles.

In the embodiment of the invention disclosed in FIG. 2, the secondary air chamber 12 functions the same as the secondary air chamber 12 described in connection with FIG. 1. The only difference is that in the embodiment of FIG. 2 air enters into the left portion 35 at the bottom of the secondary chamber 12 through perforations in the belt 46. As before, air to the right portion 40 and the bottom of secondary chamber 12 enters from under and around a head roller 45 at the bottom of the secondary chamber. As before, the total air circulation through the primary and secondary chambers is controlled by a damper 43 adjacent the air inlet 41, and an additional damper 48 is provided at the top of the hood section **12*a* of the secondary chamber 12** to provide a further individual control over air flow in the secondary chamber.

There has been described what at present are considered to be the preferred embodiments of the invention. It should be clear, however, that various modifications are possible to the specifics of the disclosed preferred embodiments without departing from the true spirit and scope of the invention. The scope of the invention is intended to be defined in the appended claims.

I claim:

1. A separator for a tobacco mixture for separating lighter tobacco particles such as leaf from heavier tobacco particles such as stem, comprising:

walls defining a primary chamber and an adjacent secondary chamber, each of said primary and secondary chambers having hood portions of gradually reduced cross sectional area at the top thereof;

means for establishing a generally upwardly air flow in said primary chamber and means for establishing a generally upward air flow in said secondary chamber;

inlet means at one side of said primary chamber for introducing tobacco mixture;

a first paddle type winnower adjacent said inlet means for projecting mixture tangentially across the primary chamber through the generally upward air flow whereby lighter particles are entrained in the rising air and carried upwardly into said hood section of said primary chamber;

a second paddle type winnower positioned at the side of the primary chamber opposite the one side for receiving mixture projected by said first winnower and projecting it tangentially back across the primary chamber through the generally upward air flow whereby additional lighter particles are entrained in the rising air and carried upwardly into said hood section of said primary chamber;

conveyor means positioned in a bottom portion of said primary chamber for receiving heavier particles which have not been air entrained in said primary chamber and carrying them out of said primary chamber, said conveyor means extending into a bottom portion of said secondary chamber and serving to project particles carried thereon into said secondary chamber, the upward air flow in said secondary chamber serving to provide additional separation by entraining additional lighter particles and carrying them upwards into said hood section of said secondary chamber;

heavy particle collection means in the bottom of said secondary chamber for collecting heavy particles which have not been air entrained in said secondary chamber; and unloading duct means coupled to the hood sections of said primary and secondary chambers at the top thereof for receiving air entrained lighter particles.

2. A separator in accordance with claim 1 wherein said means for establishing a generally upward air flow includes a source of air and diffuser means in said one wall of said primary chamber coupled to said air source, said diffuser means establishing an air flow with horizontal and vertical components in said primary chamber.

3. A separator in accordance with claim 2 wherein said diffuser means comprises one horizontal tubular diffuser and one upwardly inclined tubular diffuser.

4. A separator in accordance with claim 2 wherein said means for establishing an upward air flow in said secondary chamber comprises air conduit means beneath said conveyor means for coupling air from said diffuser means to the bottom of said secondary chamber.

5. A separator in accordance with claim 1 including a divider plate positioned in said secondary chamber and extending part way up said secondary chamber from a position approximately over an end of said conveyor means to define right and left lower portions in said secondary chamber, said right lower portion being of a relatively small cross sectional area and being inclined to the left for accelerating upwards and to the left tobacco mixture projected off said conveyor means into an upper area of said secondary chamber above said divider plate and of a relatively larger cross-sectional area, whereby air separation of lighter particles and heavier particles occurs in the upper portion of said secondary chamber with lighter particles being air entrained and carried upwards and heavier particles falling through the left lower portion onto said conveyor means for being projected again into the right lower portion of said secondary chamber.

6. A separator in accordance with claim 2 including a damper interposed between said source of air and said diffuser means for regulating the total amount of air admitted to said separator.

7. A separator in accordance with claim 3 including adjustment plates on said horizontal tubular diffuser and said upwardly inclined tubular diffuser for respectively adjusting air flow therethrough.

8. A separator in accordance with claim 4 including a damper in said air conduit means for adjusting the air flow admitted to the bottom of said secondary chamber.

9. A separator in accordance with claim 8 including an additional damper in the hood section of said secondary chamber for assisting in adjusting air flow in said secondary chamber.

10. A separator in accordance with claim 1 wherein said conveyor means comprises a belt conveyor upwardly inclined from said primary chamber to said secondary chamber.

11. A separator in accordance with claim 1 wherein said means for establishing a generally upward air flow in said primary chamber comprises a source of air and a plenum chamber positioned under said conveyor means, and wherein said conveyor means includes an apertured conveyor belt whereby air passes from said plenum chamber through said apertured conveyor belt to establish said upward air flow in said primary chamber.

12. A separator in accordance with claim 11 including a divider plate positioned in said secondary chamber and extending part way up said secondary chamber from a position approximately over an end of said conveyor means to define right and left lower portions in said secondary chamber, said right lower portion being of a relatively small cross sectional area and being inclined to the left for accelerating upwards and to the left tobacco mixture projected off said conveyor means into an upper area of said secondary chamber above said divider plate and of a relatively larger cross sectional area, whereby air separation of lighter particles and heavier particles occurs in the upper portion of said secondary chamber with lighter particles being air-entrained and carried upwards and heavier particles falling through the left lower portion onto said conveyor means for being projected again into the right lower portion of said secondary chamber.

13. A separator in accordance with claim 12 wherein said apertured conveyor belt and said plenum chamber extend across the bottom of the left hand portion of said secondary chamber so that air passing through said apertured conveyor belt establishes the upward air flow in said left hand portion of said secondary chamber, and wherein air also passes directly from said plenum chamber around the end of said conveyor means up into said right lower portion of said secondary chamber to establish the upward air flow therein.

14. A separator in accordance with claim 11 including a damper interposed between said source of air and said plenum chamber for regulating the total amount of air admitted to said separator.

15. A separator in accordance with claim 14 including an additional damper in the hood section of said secondary chamber for assisting in adjusting air flow in said secondary chamber.

16. A separator in accordance with claim 12 wherein said conveyor means is inclined downwardly from said primary chamber into said secondary chamber for assistance in retaining heavier particles thereon.

17. A separator in accordance with claim 1 including a centrifugal separator coupled to said unloading duct means for separating the air-entrained lighter particles, and lighter particle collection means coupled to said centrifugal separator.

* * * * *

UNITED STATES PATENT AND TRADEMARK OFFICE

CERTIFICATE OF CORRECTION

PATENT NO. : 4,465,194

DATED : August 14, 1984

INVENTOR(S) : G.A. John COLEMAN

It is certified that error appears in the above—identified patent and that said Letters Patent is hereby corrected as shown below:

On the title page:

Correct title is: THRESHED TOBACCO LEAF SEPARATOR

Signed and Sealed this

*Fifth* Day of *March 1985*

[SEAL]

*Attest:*

DONALD J. QUIGG

*Attesting Officer* *Acting Commissioner of Patents and Trademarks*